United States Patent [19]

Lee

[11] Patent Number: 4,691,087

[45] Date of Patent: Sep. 1, 1987

[54] PREVENTING TWIST OF A MICROWAVE TEMPERATURE PROBE LINE

[75] Inventor: Hee J. Lee, Masan, Rep. of Korea

[73] Assignee: Gold Start Co., Ltd., Seoul, Rep. of Korea

[21] Appl. No.: 925,961

[22] Filed: Nov. 3, 1986

[30] Foreign Application Priority Data

Nov. 29, 1985 [KR] Rep. of Korea ..... 15825/1985

[51] Int. Cl.[4] ..... H05B 6/68; H05B 6/80

[52] U.S. Cl. ..... 219/10.55 B; 219/10.55 E; 219/10.55 F; 219/10.55 R

[58] Field of Search ..... 219/10.55 B, 10.55 E, 219/10.55 F, 10.55 R

[56] References Cited

U.S. PATENT DOCUMENTS 4,547,643 10/1987 Yamauchi ..... 219/10.55 E

*Primary Examiner*—A. D. Pellinen
*Assistant Examiner*—Leon K. Fuller
*Attorney, Agent, or Firm*—Birch, Stewart, Kolasch & Birch

[57] ABSTRACT

A device for preventing twist of a connecting line for a temperature probe in a microwave range. An electromagnet which is automatically actuated according to a connecting rod being inserted into a jack is provided so that a steel piece of an activating lever is attracted thereto to result in a stopping pin of the activating lever being outwardly extruded from a fixing plate through an opening. A disk having a protrusion at its peripheral surface is mounted on a rotating axis of a synchronous motor in such a manner that the disk is repeatedly rotated, invertedly in its direction every time the protrusion is contacted with the stopping pin.

1 Claim, 4 Drawing Figures

FIG, 1
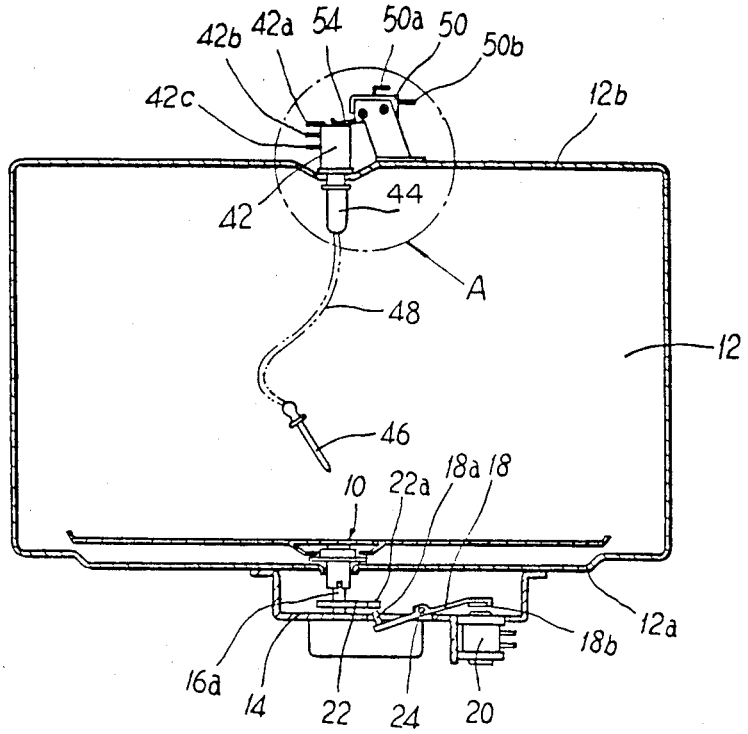
FIG, 2
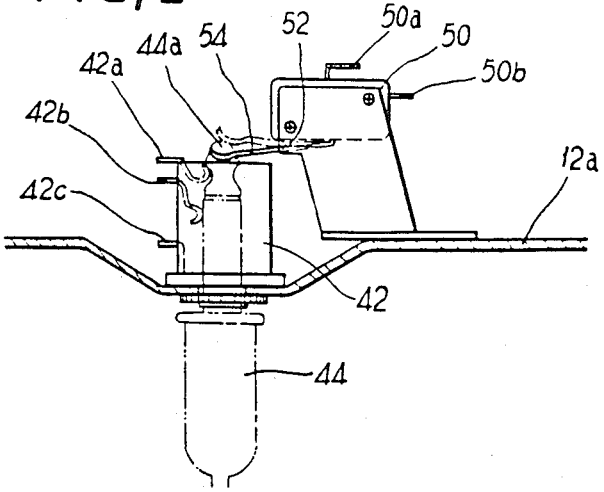

FIG, 3
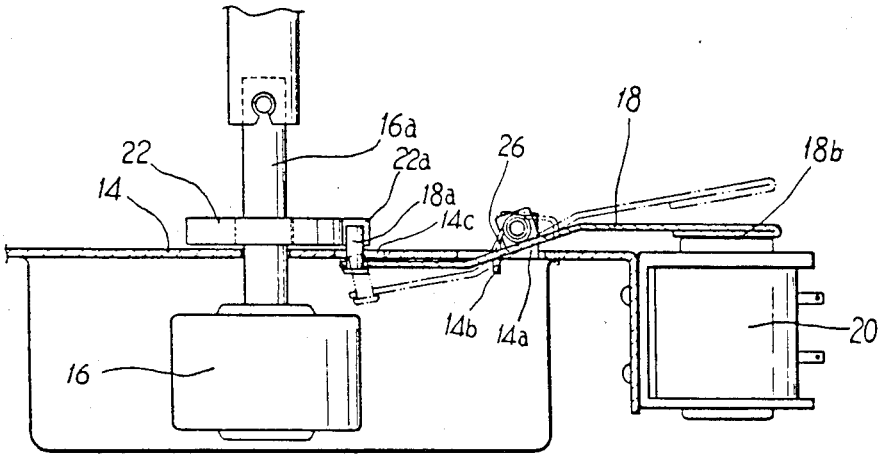
FIG, 4
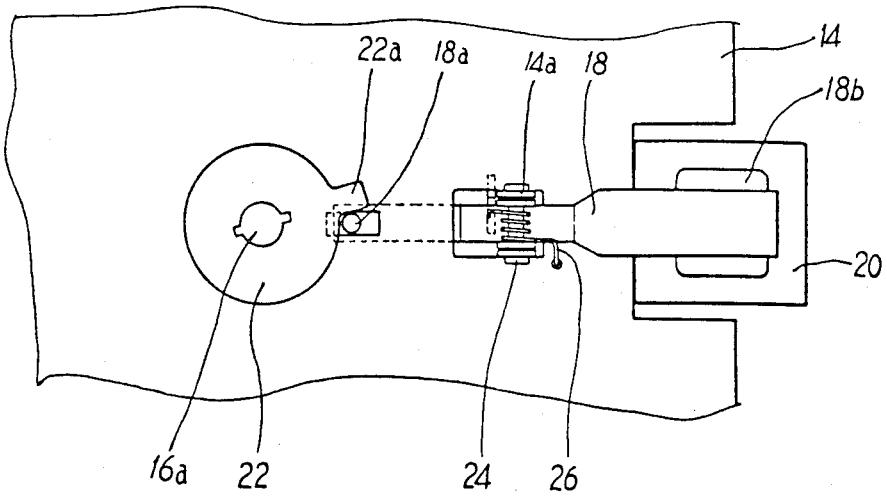

PREVENTING TWIST OF A MICROWAVE TEMPERATURE PROBE LINE

FIELD OF THE INVENTION

This invention relates to means for preventing twist of a connection line for a temperature probe of a microwave range, more particularly to means for preventing twist of a connection line by repeatedly rotating a synchronous motor in one and the other directions.

DESCRIPTION OF THE PRIOR ART

Conventionally, as a turn table type microwave range utilizes a temperature probe adapted to stick into a food to be cooked, there has been a problem of a connection line for the temperature probe being twisted, thereby not providing a precise temperature detection. A well-known system for preventing twist of a connection line takes the type in which a temperature probe is rotated in accordance with the rotation of a turn table, but this prior art causes a spark between a connecting rod and a connecting jack and requires a large number of components to be a complex construction.

BRIEF SUMMARY OF THE INVENTION

In view of the foregoing, it is the main object of this invention to provide means for preventing twist of a connection line for a temperature probe of a microwave oven without sparks between connections whatsoever.

To this end, the present invention comprises a disk provided with a protrusion at its peripheral surface and rotatably mounted on a rotating axis of a synchnous motor, an activating lever of a certain length pivotally fixed on supporting plates formed on a fixing plate by an axial pin and having a stopping pin at its one end adapted to contact the protrusion of the disk, an electromagnet adapted to attract a steel piece of the other end of the activating lever, a torsion spring with its body portion being inserted onto the axial pin adapted to urge the activating lever toward a stopping member formed on the fixing plate, and a micro switch for activating the electromagnet actuated by means of an actuating member being contacted with a contacting portion of a connecting rod.

BRIEF DESCRIPTION OF THE DRAWINGS

The above and other objects and features of the invention will appear more fully hereinafter from a consideration of the following description taken in connection with the accompanying drawings wherein one example is illustrated by way of example.

In the drawings

FIG. 1 is an elevational view partially in section of a preferred embodiment of this invention, FIG. 2 is an enlarged view of the portion within circle "A" shown in FIG. 1, FIG. 3 is a partially cut-away view of main components by means of which the present invention may be practiced, and FIG. 4 is a plan view of the components shown in FIG. 3.

BEST MODE OF CARRYING OUT THE INVENTION

Referring first to FIGS. 1 and 3, there is shown a partial cross sectional view of a preferred embodiment of this invention. A turn table 10 is mounted on the bottom plate 12*a* of a heating chamber 12 to which a fixing plate 14 is attached to fix a synchronous motor 16, an activating lever 18, and an electromagnet 20 thereon. A disk 22 having a protrusion 22*a* at its peripheral surface is rotatably mounted on a rotating axis 16*a* of the synchronous motor 16. The activating lever 18 is movably mounted on supporting plates 14*a* formed on the fixing plate 14 with an axial pin 24 onto which a torsion spring 26 is inserted to urge the activating lever 18 toward a stopping member 14*b* protruded from the fixing plate 14. The activating lever 18 includes a stopping pin 18*a* at its one end adapted to pass through an opening 14*c* piercing the fixing plate 14 and to contact the protrusion 22*a* of the disk 22, and a steel piece 18*b* at the other end adapted to be attracted to the electromagnet 12. On a top plate 12*b* of the heating chamber 12, there are provided a jack 42 adapted to connect with a connecting rod 44 of a probe 46 having a connecting line 48, and a micro switch 50 for actuating the electromagnet 20, which will be more specifically described hereinafter.

Referring to FIG. 2 in which an enlarged view of the portion within circle "A" of FIG. 1 is illustrated, there is shown means for actuating the electromagnet 20 by means of an actuating protrusion 52 adapted to be exerted by an actuating means 54 which is thrusted according to the connecting rod 44 being inserted into the jack 42 and to a contacting portion 44*a* of the connecting rod 44 being contacted with the actuating means 54. The micro switch 50 includes connecting terminals 50*a* and 50*b* which are connected to an electromagnet driving circuit. (not shown) Reference numerals 42*a*, 42*b* and 42*c* are connecting terminals which are interconnected to a controller (not shown) positioned in the interior of the main body to automatically control the temperature of food being cooked.

Provided the probe 46 is stuck into a food to be cooked and the connecting rod 44 is inserted into the jack 42 fixed on the top plate 12*b* of the heating chamber 12 for an automatically temperature-controlled cooking, the contacting portion 44*a* of the connecting rod 44 is intended to contact and push the actuating means 54 to result in the actuating protrusion 52 being exerted. Thereby, the micro switch 50 is closed to actuate the electromagnet 20 so that the electromagnet 20 attracts the steel piece 18*b*and the activating lever 18 is turned to the position depicted in solid line from the position in imaginary line overcoming the force of the torsion spring 26 as shown in FIG. 3. Accordingly, the stopping pin 18*a* is separated from the upper surface of the fixing plate 14 through the opening 14*c*.

Meanwhile, the disk 22 is rotated in pursuance of the synchronous motor being rotated, when a power source is applied thereto. If while the disk 22 is rotated the protrusion 22*a* thereof is contacted with the stopping pin 18*a* of the activating lever 18 as shown in FIG. 4, the rotation of the disk 22 is reversed pursuant to the reversed rotation of the synchronous motor 16. Thus, the rotation of the disk 22 is repeatedly inverted in one and the other directions, each time the protrusion 22*a* is contacted with the stopping pin 18*a*.

Further, if the connecting rod 44 is pulled out from the jack 42 for the purpose of a general cooking, the electromagnet 20 is rendered ineffective so that the lever 18 is restored by the restoring force of the spring 26 from the position depicted in solid line to the position in imaginary line in FIG. 3. As the stopping pin 18*a* is extracted from the opening 14*c* and moved downward toward the below, the turn table 10 may be continuously rotated irrespective of the stopping pin 18*a*.

As set forth hereinbefore, the present invention enables a microwave range to effect an automatically temperature-controlled cooking without twist of a connecting line 48.

As this invention may be enbodied in several forms without departing from the spirit of the essential characteristics thereof, the present embodiment therefore is defined by the appended claim and not restrictive, since the scope of the invention is defined by the appended claim rather than by the description preceding it, and all changes that fall within meets and bounds of the claim, or equivalence of such meets and bounds are therefore intended to be embraced by the claim.

I claim as my invention:

1. Means for preventing twist of a connecting line for a temperature probe in a microwave range comprising, a disk provided with a protrusion at its peripheral surface and rotatably mounted on a rotating axis of a synchronous motor, an activating lever pivotally fixed on supporting plates formed on a fixing plate by an axial pin and having a stopping pin at its one end adapted to contact said protrusion of said disk and at the other end a steel piece, an electromagnet to attracting said steel piece of said activating lever on its operation, a torsion spring with its body portion being inserted onto said axial pin to urge said activating lever toward a stopping member formed on said fixing plate, and a micro switch to activate said electromagnet by means of an actuating protrusion contacted and pushed by an actuating means which is thrusted according to a connecting rod being inserted into a jack.

* * * * *